United States Patent [19]

Hecker et al.

[11] 4,425,608

[45] Jan. 10, 1984

[54] LUMINOUS DISPLAY INSTALLATION WITH AN INCREASED CONTRAST EFFECT

[75] Inventors: Gyula Hecker; Ernó Kenéz; László Nyári; János Patta, all of Budapest, Hungary

[73] Assignee: Villamos Berendezés és Keszülék Müvek, Budapest, Hungary

[21] Appl. No.: 346,418

[22] Filed: Feb. 8, 1982

Related U.S. Application Data

[63] Continuation of Ser. No. 157,070, Jun. 6, 1980, abandoned.

[51] Int. Cl.[3] ..... F21V 7/00

[52] U.S. Cl. ..... 362/291; 362/290; 362/297; 362/304; 362/305; 362/308; 362/309; 362/327; 362/328; 363/329; 362/335; 362/342; 362/343; 362/346; 362/347; 362/354; 362/359; 362/360; 362/361

[58] Field of Search ..... 362/290, 291, 297, 304, 362/305, 308, 309, 327, 328, 329, 335, 342, 343, 346, 347, 354, 359, 360, 361

[56] References Cited

U.S. PATENT DOCUMENTS 3,325,238 6/1967 Geier ..... 362/308

3,768,900 10/1973 McLintic ..... 362/308

*Primary Examiner*—Stephen J. Lechert, Jr.

*Attorney, Agent, or Firm*—Gabriel P. Katona

[57] ABSTRACT

An improved optical system for the light point on an illuminated signal or display device having one or more light points. The system comprises one or more light deflectors optically coupled with the light source of the light point and focussing the light passing through the effective aperture of the deflectors towards a focal point or line, respectively, and one or more light shields arranged in the light path and provided with an aperture in the focal point or line whereas a plurality of the deflectors with the corresponding light shields may be arranged in the rows and columns of a display board. The mantle of the light shield frames a hollow in a manner that its mouth is facing the light deflectors and the mantle is under a bevel narrowing towards the aperture of the light shield and the mantle is arranged parallel to and encircling rays departing from the periphery of the effective aperture of the light deflectors and converging into the focal point or line.

15 Claims, 14 Drawing Figures

LUMINOUS DISPLAY INSTALLATION WITH AN INCREASED CONTRAST EFFECT

This application is a continuation of Ser. No. 157,070, filed on June 6, 1980, now abandoned.

The invention relates to a luminous display installation, which—compared to known solutions —ensures a more advantageous contrast effect, since it is able to eliminate or at least to minimize considerably the contrast deteriorating effects resulting form the outer space.

In general, the conceptual class of luminous display equipments comprises the circle of all kinds of equipments, which are delivering an information in form of a luminous effect for the viewer. In course of our specification this conceptual class will be interpreted within a narrower scope; all the equipments shall be classified as luminous equipments, at which contrast is playing a significant role in respect to the efficiency of the luminous display and which are containing light energy radiating light sources, one or more elements influencing the path of of the light ray, f.i. a mirror, light deflecting or screening means, /a transparent, translucent, coloured or colouress, displacing or refractive/ bulbs and the function of which is to deliver any information for the person or a technical device, i.e. for the viewer, viewing the luminous display equipment from a given range of the solid angle by means of the difference between the brightness levels belonging to the different operational conditions of the light source/s/.

Traffic light are representing one of the main field of application of these equipments. In the luminous installations serving for this purpose mostly one single light source has been used, but in general two or three equipments of this kind used to be arranged below or beside each other, respectively, with the purpose to give an information forming the condition of progress for the viewer, viewing from the direction of the sidewalk or the drive-way /foot-passengers, drivers, cyclists etc./: so f.i. the red light indicates a prohibition, the green light allows the advance. It is an essential requirement, that at luminous installations applied as trafic lamps or as the elements thereof, the switched an switched-off state should be well distinguishable in a reliable manner, independent of the fluctuation of the enviromental illumination. It goes without saying, that an error may result in severe situations being dangerous to life and in accidents, in severe financial damages etc. It is a well know fact, that green reflection arising under the influence of sunshine involves significant problems.

An other characteristic example for the equipments previously described is represented by the luminous displaying equipments i.e. the "light points" incorporated therein. In general, in this tables, delivering informations, a mass of light points is arranged, mosthly in columns lying beside each other or lines arranged beneath each other, having been shaped and oriented in the same manner, in the most cases the entire light field is formed of more hundreds or more thousands of elementary lighting units. Previously, by means of the luminous displaying equipment realizing the elementary light point information could be displayed only by changing the operational state of one single light source. Recently multi-coloured tables became more and more popular, in case of which the luminous displaying equipment realizing the elementary light point contained in most cases a common optical system for the display of the states of the light source. /Taking into consideration, that from the point of view of our invention the number of the light sources having been arranged in the optical system does not play a qualifying role, when commenting our invention, often monochromatic light sources with one light source are mentioned, nevertheless, everything, that will be said, is relating—according to sense—to light sources formed with several light sources, accordingly, they are included in general definitions/.

Often the announcing boards consist of the mass of light points arranged in a matrix-like manner, while the whole board is divided in to several fields of light points. Within these, in the single groups of light as many elementary light points are united, as it is needed to display an alphanumerical character each in accordance with the casual combination of the operational conditions of the light sources united therein; in case of a selective control for the single light points stationary, moving /flashing or rolling/ images in an optional number may be displayed. From the aforesaid it emerges, that the satisfactory quality of the image can be obtained in case of announcing boards, when in the image—displayed as an entirety of the image-points—the information content of the single light points appears with a minimal distortion. In this case, the prerequisite of visibility and legibility can be complied with, when there is a significant difference between the surfacial brightnesses of the switched and switched-off state, respectively, in a given case according to a predetermined stage of brightness, i.e. when there is a considerable contrast in the light field between the surfacial brightness of the displaying units having been switched or switched-off. The momentary brightness level of the enviroment my increase or decrease the contrast effect /night-or day level etc./, simultaneously the surfacial brightness caused by the light sources in the outer space and appearing on the switched-off displaying equipment may also weaken the contrast.

In case, if the natural or artificial illumination coming from outside is low, /a not illuminated closed space, e.g. the auditorium of a cinema, a free place in a moonlight-free night/, light sources of a minimal output might be sufficient for ensuring satisfactory interpretability and sensing. In a sunlit enviroment a satisfactory contrast effect at the luminous display equipment subjected to direct solar radiation can be obtained with difficulties only.

An obvious method for increasing the contrast effect lies in the increase of brightness by increasing the output of the light source. This method is, however, restricted by the conditions of realization /dimensions, heating/ and particularly by the conditions of economicalness /costs of investment, energy consumption, increasing cost of maintenance/.

The contrast spoiled by the external light effects arriving onto the useful surface of the luminous display equipment may be considerably decreased by the expediently light-absorbing shape of the surfaces, as well as by the formation being compliance with the enviromental space, f.i. by painting the casings or other screening means. As a consequence, the light effect arriving onto the luminous display equipment having been switched-off will be reflected in a minimal extent as a surfacial brightness.

In the solid angle of display intensity of light may be increased by deflecting the light of the light source, e.g. by using lens, deflecting and screening means, respectively, mirrors, enclosing pipes etc.

In practice these methods have been mostly used, applied separately or combined, since increasing the output of the bulbs has been utmost expensive, besides it is to be considered as disadvantageous regarding to energy economy.

The invention is further illustrated with reference to the drawing in which.

FIGS. 4 through 9*b* show schematic illustartions of various embodiments of the invention.

Figure 1:
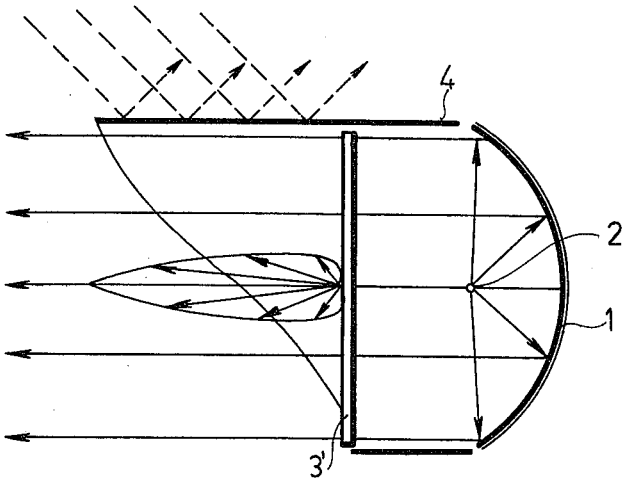
FIG. 1 is a schematic illustration of a luminous display apparatus.

In FIG. 1 a preferable embodiment of a luminous display equipment widely used in traffic lamps has been schematically illustrated. The light of the light source 2 /an electric bulb/ is deflected by the reflector 1—formed by a paraboloid mirror—in the main direction of viewing; in the path of the nearly parallelly advancing rays of light there is a glass bulb 3' with scatterring characteristics arranged, which is scattering circle-symmetrically with the axle of the main direction a part of the rays arriving approximately parallel to the glass bulb, ensuring in such a manner a greather solid angle of viewing. Above the bulbs there is a screenlike screening body 4 arranged, resulting in an orientation—depending screening against direct solar radiation.

While in case of traffic lamps, taking their purpose and destination into consideration, at the different variations and embodiments formation of the luminous display equipments is fundamentally similar, due to the variety and different scopes of application, in case of luminous information displaying equipments, the number of variations and embodiments is not only higher, but differences may be found in relation to shaping characteristics too. Nevertheless, there are certain common features, in order to comprehend the invention, one has to start from these characteristics. Accordingly, a basic solution and an improved version thereof will be described.

Figure 2:
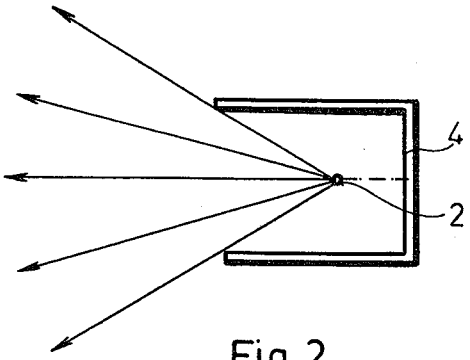
FIG. 2 shows schematically the application of a luminous display apparatus as an elementary light point.

In FIG. 2 the basic solution of a luminous display equipment applied as an elementary light point has been schematically illustrated, this basic feature can be demonstrated also in case of more complicated embodiments. The light of the light source 2 is travelling directly in the desired direction. The primary aim of the screening body 4 /formed as a light deflecting device enclosing a cylindrical or prismatic space, eventually of the form of a cone/ is to prevent inter action between the confining light points, while screening against external light is representing but a secondary task.

This basic solution used to be completed by a mirror, by different bulbs /translucent, prismatic, milled bulbs, or provided with an elementary lens/, by sreening bodies, /wire-nets, expanded boards, different jalousie -like screens, or screens consisting of concentrical circles, radial profiles/.

The common characteristics of the different, known luminous display equipments partly provided with contrast improving means lie in, that the individual effects of the measures taken for completing the solution according to FIG. 2 could not be entirely summarized, on the contrary, in several cases the effect of one of the measures has spoiled the efficiency of an other measure. So e.g. the screening—grid is adsorbing a part of the light of the light source or deflects the light in an undersired direction; by this action the advantageous effect obtained by the device serving for deflecting the light in the desired direction has been partly spolied.

Figure 3:
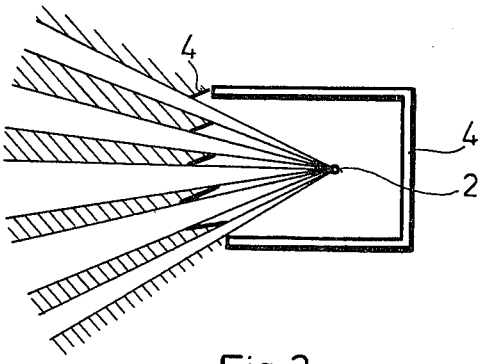
FIG. 3 illustrates a screening body as a grit.

Let us see a further-developed version of the basic solution illustrated in FIG. 2, having been illustrated schematically in FIG. 3. It may be well seen, that a further screening body formed as a grid has been inserted into the path of travel of the light of the light source 2. Without this arrangement /accordingly, at an arrangement illustrated in FIG. 2/ the characteristics of radiation are circle-symmetrical in relation to the axle of the luminous display unit. These characteristics of radiation are essentially identical with the characteristics of radiation of the light source 2 within the range restricted by the deflection caused by the tube, but due to said restriction only 25–30% of the light of the light source 2 is leaving the luminous displaying equipment in the desired solid angle, as a consequence, utilization of light is rather disadvantageous.

Besides, the equipment having not been provided with the screening body 4 is practically worthless in day-light, since external light effect is producing such a high illumination level on the opal electric bulb, that the difference between the surfacial brightnesses in the switched and switched-off state, respectively, can be hardly sensed.

The screening body 4 formed as a grit, illustrated in FIG. 3, has been used for improving the contrast effect. After having mounted the screening body /bodies/ 4, the illumination level produced by external light effects will considerably decrease, since a part of of the external light is entrappend by the screening grid painted in black. Simultaneously the screening grid is retaining a part of the light rays arriving from the inside of the light source.

The aim of the invention is to eliminate or to minimize the contrast weakining effect of external light energies by using devices, which neither adsorb a part of the light energy deflected in a useful direction, nor deflect them in an unwanted direction.

The invention is based on the physical fact, that the light can be deflected, practically without losses, by using different optical elements /mirrors, prisms, lenses etc./ in a manner well know from optics, if we find the optimal shape and arrangement complying with requirements. To obtain lossfree screening, the well known property of the optical systems has been exploited, in so far as they are able to collect the rays of light coming from different directions and travelling on parallel paths convergently in a given point, i.e. in the focal point /focussing/.

In the following we shall consider all optical systems as a "collecting" /focussing/ system, which is performing said function, indpendent of the fact, whether the system is containing a collecting mirror or a collecting lens at all; it is a well known fact, that even by using elements of different individual characters, by the mutual arrangement of the optical system it can be achieved, that the rays of light travelling through the larger cross-section of the resultant system should be collected in one single point, representing the focal /characterizing/ point of the optical system. In the following, when it is not separately indicated, that we are speaking of the focus of some of the elements of the optical system, under the nomination "focal point" the characterizing focal point of the system is meant, into which—due to the resultant characteristics of the system—the rays of light are collected.

Any parallel beam of rays can be collected into one point by means of collecting lenses. In case, if the light of the pointlike light source contained in the luminous display equipment is transformed into a practically parallel beam of light by means of a reflector, e.g. a paraboloid mirror, /i.e. the mirror has been arranged in the focus of the mirror/, and collecting lenses are placed in the path of the beam of light, the light energy deleivered by the light source will pass in its entirety through a small, practically pointlike cross-section, lying perpendicularly to the optical axle of the lens and incorporating the focal point of the lens. Let us now place a black screening plate before the lens in the plane, lying perpendicularly to the optical axle of the lens and incorporating the focal /characterizing/ point of the system, and cut an orfice in the screen in a point having been cut out by the optical axle of the lens, amounting but to a fractional part of the useful illuminating surface of the reflector, i.e. resulting from the proportions of dimensions a diaphragm aperture is cut in relation to the focussed beam of rays,

- the light energy irradiated by the light source and collected in the focal point by the lens may leave the system through the diaphragm aperture—as it is well known—without any losses and unhindered, but simultaneously
- due to the arrangement according to the invention only a fractional part of the external enviromental light—defined by the proportion between the cross-section of the diaphragm aperture and the useful surface of the luminous display equipment—will be seen in the diaphragm aperture and only this fractional part will be able to deteriorate the contrast in the useful solid angle of the luminous display installation.

Figure 4:
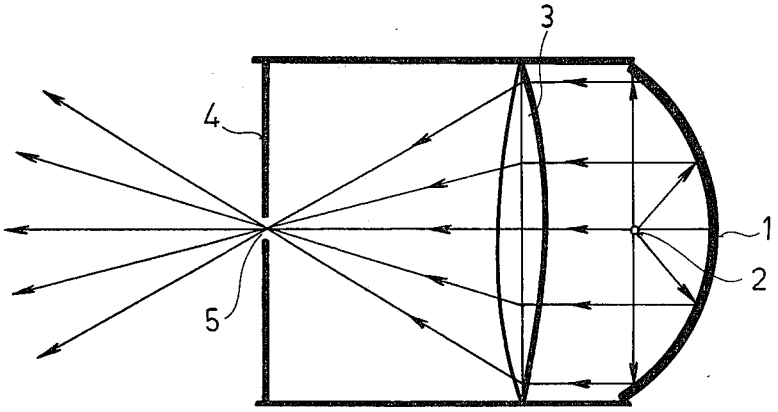

The embodiment based on this consept is to be seen in FIG. 4; it may be well seen, that the light energy coming from the reflector 1 and guided into the focal point of the lens by the collecting lens 3 may leave unhidered though the diaphragm aperture 5 formed in the focal point, while the screening body 4, represented by a black board arranged accurately in the plane incorporating the focal point, is considerably restricting the illuminating effect caused by the external light energy. Furtheron we shall see, that by the expedient shape of the screening body 4 the contrast improving effect of the system can be further increased, the reflexion of the rays reflected onto the screening body 4 in the direction of the useful solid angle can be further decreased.

It goes without saying, that the same effect can be achieved, when guiding the light into the focal point is taking place without the use of a lens, but the reflector itself is formed in such a manner, that from there the rays should be reflected after having been collected in the focal point.

Figure 5:
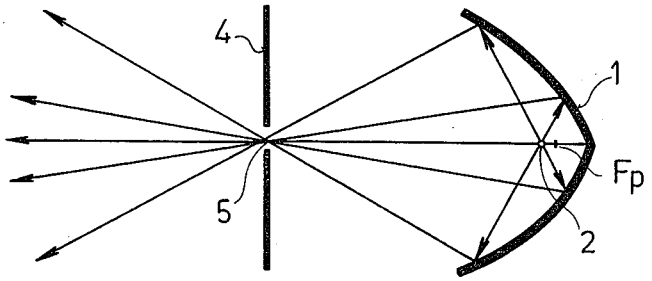

A further version of the embodiment of the invention has been illustrated in FIG. 5. As we have seen, the reflector 1: formed as a paraboloid mirror, is reflecting the rays in parallel beams, when the light source 2 is arranged in the focal point $F_p$ thereof. Conversely, when the light source 2 is arranged outside the focal point $F_p$ of the same paraboloid mirror, the optical system formed in such a manner will possess a further focal point along the optical axle of the mirror, and the rays of light will be convergently reflected in said focal point. Regarding the optical system, this is to be considered as a real focal point, but it is differing from the focal point $F_p$ of the paraboloid mirror. In this case the same effect can be produced, as by the application of the arrangement illustrated in FIG. 4, where the rays coming from the reflector 1 on parallel paths have been collected by the collecting lens 3 into the focus of the optical system. In the arrangement according to FIG. 5 the light energy irradiated by the light source 2 and reflected by the reflector 1 may also travel unhindered through the diaphragm aperture 5 formed in the focal point of the optical system without any loss.

The same effect may be achieved without a separate collecting lens 3, when the reflector 1 is an ellipsoidal mirror and the light source is arranged in the focal point of the mirror. Such mirrors have a further focal point and in this case this focus will represent the characteristical focal point of the optical system, into which the system reflects the rays of light of the light source 2 and where the diaphragm aperture 5 is formed in the screening body 4.

By the detailed description of the three examples we intended to demonstrate, that for the realization of the invention the optical systems—possessing different individual features—can be successfully used, when they are complying with one single requirement: the resultant optical system should have a focal point, into which the system is able to collect the rays of light reflected by the reflector 1. The technician will be able to form several optical systems by using the apparatuses known from geometrical optics. The systems of such types—having been previously utilized for several purposes—can be well applied for a further function in accordance with the invention, when instead of the screening elements used up to now in luminous display units the screenings formed and arranged in sense of the invention are used in the optical system.

In a strict sense the focal point of the reflector is a point without dimension. When we are speaking about the light source arranged in the focal point of the concave mirror, even in case of one single light source, this statement is to be considered as an approximation often used in optics; in fact, the light source is arranged in a larger space, simultaneously incorporating the focal point of the mirror, that is why we have always mentioned the approximately parallel running reflected rays. If in the space—called as a focal point, but actually being far more spacious—several light sources—e.g. of different colours—are arranged, the approximation is as long acceptable /and in the future all definitions should be interpreted in such a sense/, as

- when comparing the enclosing space of the light sources and the dimensions of the mirror, in regard to optics the space is still representing an approximately point-like space, or
- the shape of the apparatus is such, that in case of colour selection related to the light point—similarly to revolver-optics—always the light source of the selected colour is springing into the "focal point".

Accordingly, the invention relates to a luminous display installation, containing an optical system with a reflector arranged behind the light source/s/ and a screening body.

The invention is based on the recognition and the essence thereof lies in, that the optical system applied is having a collecting character and the screening body is formed by the screen arranged before the optical system, facing the same and in said screen, in the point cut out by the optical axle, the diaphragm aperture has been formed.

In case, if the reflector is a paraboloid mirror, the light source should be arranged outside the focal point. In case, if the reflector is an ellipsoidal mirror, the mirror should be placed in the focal point of the mirror.

In particular, those versions of the invention can be considered, as most advantageous, at which the resultant collecting character of the optical system has been formed by inserting one or more collecting lenses, as accessory optical elements. In this case, the reflector is formed by a concave, expendiently paraboloid mirror, and the light source/s/ is /are/ arranged in the focal point of the mirror, accordingly, a parallel beam of rays will be reflected, /from the point of view of technology the paraboloid mirror can be considered for the moment as the most advantageous solution, but other types of collimator mirrors can be successfully used/; before the light source one or more collecting linses are arranged and the screening body /bodies/ is /are/ formed by a screen /or screens/ having been arranged before or opposite to the collecting lens/es/ and in the screens, in the points cut out by the optical axle/s/ of the collecting lens/es/ the diaphragm aperture/s/ is /are/ formed.

The conceptual class of the collecting lens has been generally interpreted; all types of lenses are to be ranked into said class, which are producing the previously mentioned, convergently guiding, focussing effect. Accordingly, one may use slices of cylindrical lenses, preferably the plano-convex slices of cylindrical lenses. In this case, the slices of the cylindrical lens to be used in accordance with the invention are to be interpreted in such a manner, that the slice is cut out along at least two cutting planes running parallel with the geometrical axle of the cylinder. Besides, the slice of the cylindrical lens is having a convex surface too, also running parallel with the geometrical axle of the cylinder, said convex surface is rendering the slice of cylindrical lens a device with collecting characteristics.

In order to obtain further accessory advantages, the slices of the cylindrical lens of collecting character may be completed by further slices of the cylindrical lens without collecting characteristics, f.i. of the plano- concave form.

In course of the description of the optical systems according to the invention we are calling the geometrical axle of the cylinder, from which the slice has been cut, "the geometrical axle" of the slices of the cylindrical lens, whether said axle is transgressing the slice, or not.

Besides, the collecting lenses of the form of the slice of a cylindrical lens possess a focal line running parallel with the geometrical axle, the rays of light arriving parallel to the lens are convergently guided to this line. In the technical literature this line is called "focal line".

According to one of the preferable embodiments of the invention the reflector is a concave, expediently paraboloid mirror, while the light source is arranged in the focal point of the mirror; before the light source there is /are/ the collecting lens/es/ of the form of a slice of the cylindrical lens arranged, while the screening bodi /bodies/ are formed of a screen, /screens/ placed before and opposite to the collecting lens/es/, and in said screen/s/, along the line/s/ cut out by the plane/s/ running parallel with the optical axle of the reflector and incorporating the focal line of the collecting lens/es/, the diaphragm aperture/s/ is /are/ formed.

The invention will be described in detail by means of the accompanying drawings, which are showing the schematical construction of the preferable embodiments of the luminous display unit in accordance with the invention.

Figure 6A:
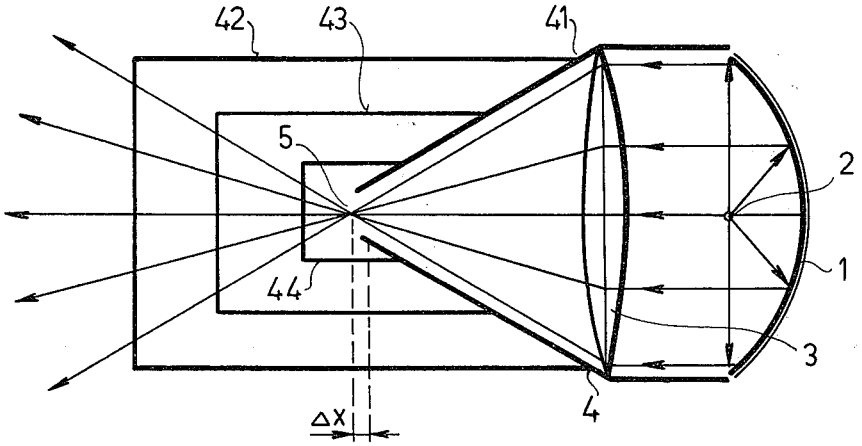
Figure 6B:
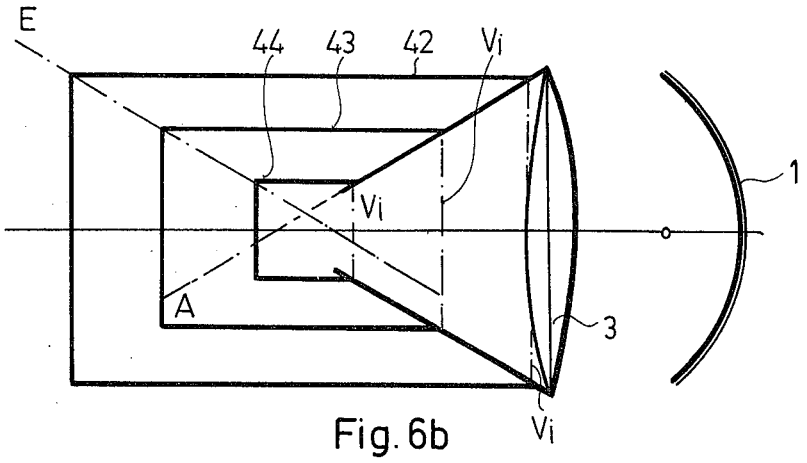

In FIG. 6 an embodiment has been schematically illustrated, at which a collecting lens has been arranged before the reflector and the sole diaphragm aperture of the screening system is arranged in the environment of the focal point of the collecting lens.

Figure 7A:
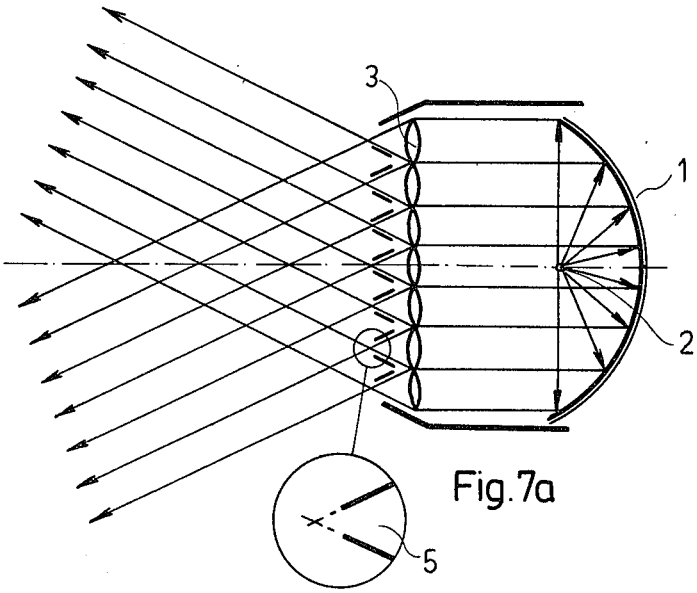
Figure 7B:
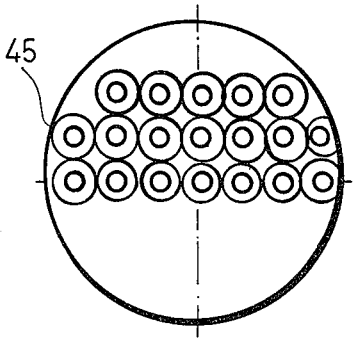
Figure 7C:
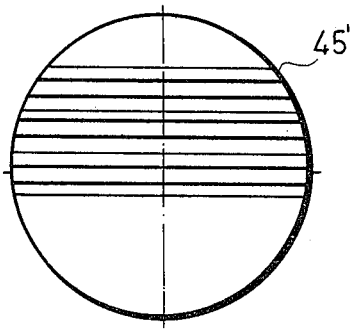
Figure 8A:
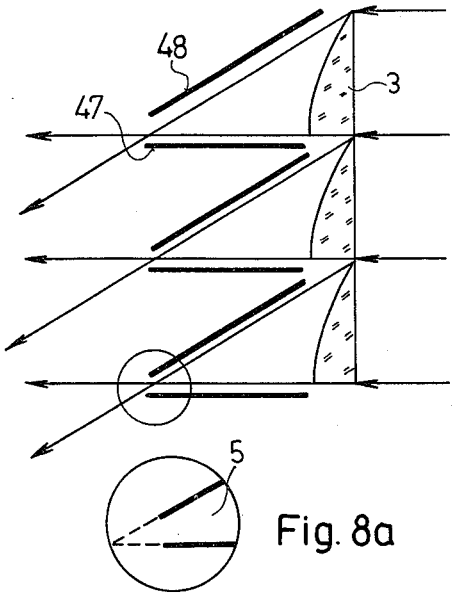
Figure 8B:
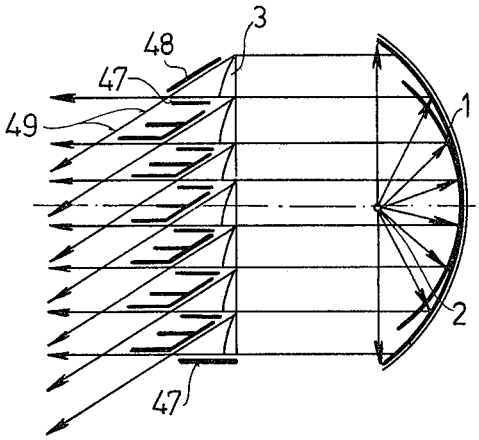

In FIG. 7 an embodiment has been shown, at which before the light source/s/ a multitude of collecting lenses and screening bodies is arranged, while in FIG. 8 the version has been illustrated, at which the system of lenses and the system of the screens are performing an accessory deflection as an interaction.

Figure 9A:
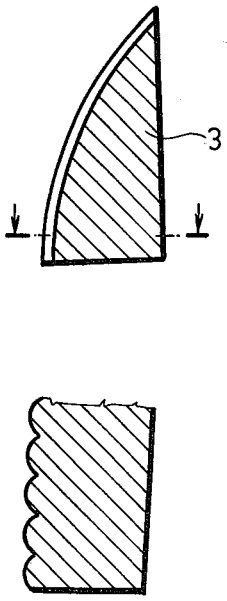
Figure 9B:
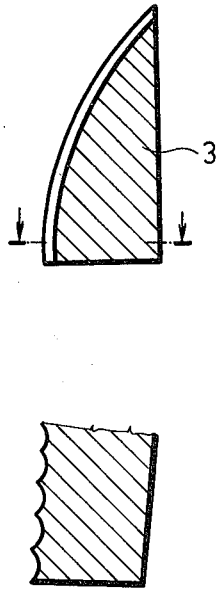

In FIG. 9 the embodiment may be seen, at which further slices of the cylindrical lens has been attached to the convex surface of the collecting lens of the form of the slice sog the cylindrical lens.

Already the schematical illustrations shown in FIG. 4 and 5, respectively, are demonstrating the fundamental advantageous functional conditions of the equipment according to the invention, which could be demonstrated for all the embodiments described here. The brightness is increased but by the part of the external energy falling onto the schreen/s/, which is proportional to the cross-section of the diaphragm aperture 5, while in a switched state the rays of light, irradiated by the light source 2 and reflected by the reflector 1 are completely contributing to the brightness prevailing in the diaphragm aperture 5. The direct external environment of the diaphragm aperture 5 is formed by the screening bodi /bodies/ 5 painted in black, which are reflecting an insignificant part of the external light energy, even at a strong sunshine. Accordingly, however under the same circumstances, the contrast will be considerably higher, than at the known luminous displaying units, and in general, a better efficiency can be obtained. Simultaneously, the absolute value of brightness is also higher, since compared to the significant losses in light caused by the contrast improving means, the screen according to the invention results in a smaller loss. The losses, which arise inspite of the arrangement previously described, result from the fact, that a part of the rays of light of the light source/s/ 2 does not reflect directly from the reflector 1 in the focussed direction, but travels directly towards the screen and is distributed on the entire surface of the screen. The situation at this kind of light energy is the same, as at the external disturbing light: only the rays arriving into the diaphragm aperture 5 are increasing the surfacial brightness. The loss occurring in such a manner, is not more, than approx. 10%, mostly 15% of the light output of the light source/s/ 2, and the amount of loss can be further reduced, e.g. by the suitable choice of the shape and quality of the surface and by the application of other methods known in itselves.

The undesired reflection of the disturbing light of external origin can be further decreased, if the screening body 4 is not a plain board, but by means of the surfacial orientation it may contribute to the achievement of the optimal screening effect.

A certain degree of improvement may be obtained, when the screen is formed as a concical mantle; an even better result may be obtained, when a system of screens containing a concical mantle is applied. A preferred embodiment of this solution may be seen in FIG. 6, where from the essentially conforming FIGS. 6/*a* and 6/*b* in FIG. 6/*a* peculiarly the light deflecting mechanism has been illustrated, while in FIG. 6/*b* the structural characteristics of the arrangement of the system may be seen.

The screen resp. the screening element, i.e. the part thereof lying opposite to the collecting lens 3 is formed by the concial mantle 41. The altitude of the conical mantle 41 coincides with the optical axle of the collecting lens lying opposite, while the fundamental circle is facing the collecting lens 3, the diaphragm aperture is formed in the vertex of the cone. To the outside of the conical mantle 41 one or more pipes 4, 43, 44 are connected /in case of more pipes, the diagonals are following each other in a decreasing order of sequence/. The cross-section of the pipe/s/ conforms to the cross-section of the conical mantle 41, shown in the matching line Vi in FIG. 6/*b*, i.e. the cross-section of the pipe/s/ 42, 43, 44 is formed by a circle, the diameter of which is conforming to the diameter of the upper side of the truncated cone, cut out by the plane of the matching line Vi. The longitudinal axis of the pipe/s/ is running parallel with the optical axle of the collecting lens 3 and the reflector 1, respectively.

The length of the pipes should be selected on basis of the radial section, i.e. in compliance with the requirements different pipe lengths can be selected, but it must not surpass the maximal length resulting from the radial section, at which the pipe cannot protrude into the path of the useful kight energy travelling from the diagphragm aperture 5 towards the viewer.

Accordingly, in an extreme position, which is to be considered theoretically as the optimal arrangement, the straight line E, running into the optical axle and contacting the free end/s/ of the pipe/s/ is axially symmetrical with the generatrix A of the conical mantle 41 running into the optical axle in the same plane and related to the axle lying perpendicularly to the optical axle. Taking the aforesaid as a basis, the technician may estimate the reflection diminishing effect of the embodiment, eliminating disturbing reflecting factors and he is able to shape and to dimension the system in compliance with the conditions of the concrete field of application. In case of an optimal form the reflection of the external light energy in the useful direction—after having fallen onto the screen—practically equals to zero, accordingly, the brightness of the useful surface of the luminous display equipment in the switched-off state of the light source/s/ 2 will be negletcible small, even at a great environmental brightness/, the simulation of the absolute black body/.

In luminous boards delivering some kind of information the arrangement has been widely used, that the light points are arranged in columns lying beside each other or in lines arranged below each other, while the screening bodies are formed of pipes with a rectangular cross-section, which—having been arranged perpendicularly to each other in two directions—are filling the whole space of the board.

The effect according to the invention may be also obtained, when the enclosing frame of the optical system is having a rectangular cross-section, furthermore the reflector 1 and the collecting lens 3 are also cut out with such a circumference from the fundamental profile, which is usually shaped with a circular cross-section.

In this case the screening element illustrated in FIG. 6 has to be modified. The mantle is not the mantle of a cone, but that of a pyramid, preferably with a rectangular base. The base of the pyramid is lying opposite to the collecting lens 3, while the altitude coincides with the optical axle and the diaphragm 5 is formed in the vertex of the pyramid.

As already mentioned, the collecting lens 3 may be formed of a slice of a cylindrical lens. In this case the diaphragm aperture 5 is not point-like, but it is formed by a linear—horizontal or vertical—gap. The screening system will deviate from the cross-section of the body of rotation in this case too. The pyramidal mantle mentioned before, can be also used. In general, the screen i.e. the screening element is formed of plain surfaces—yielding the effect according to the invention, as previously described—or by curved planes, which are matched to each other in such a manner, that in relation to the focal line they should realize the same screening effect, as a conical mantle in case of a point-like diaphragm aperture. Beside planes with curved directrix planes with a broken directrix can be also used with good results.

The vertical and horizontal direction are given as the internal reference characteristics of the system /similarly the definition of a column or a line/. It is possible, to assembly the luminous display equipment in an angle, that the embodiments illustrated here—taking the earth surface as the horizontal—are taking up a position, which is different from that in the figure: lying in the plane of the figure or rotated around an axle being perpendicular to that in an optional angle, when the definitions "horizontal", "Vertical" etc. do not express any more vertical resp. horizontal directions in the outer geometrical system, but different f.i. an oblique directions. Nevertheless, every definition contained in our specification, in relation to the mutual positions within the elementary luminous display equipment forming a closed geometrical system, is to be considered, as valid. At the embodiments to be described furtheron, the definitions "vertical", "horizontal" etc. are valid within the coordinate system shown in the figure and they are used in a general sense; by keeping their relative meaning, they can be transformed into any other direction on the place of assembly, but with the restriction, that all directions defined in an elementary system are turned and rotated in the same sense and extent.

The function of the luminous display units is not identical with that of the illuminating bodies, the aim set is not to illuminate the objects lying in the effect-sphere; the display unit is showing an image for the viewer placed in the effect-sphere and the main aim is that the different states of the luminous display equipment could be easily and unambiguously distinguished. The aesthetic sight of the switched and unswitched display equipment is representing an important factor too.

In certain cases /when f.i. in traffic lamps the illuminating image of the arrow showing the direction of progress appears or on scoreboards lighting figures and letters are displayed/ the unambiguous distinction of the switched and switched-off state does not seem to be sufficient. It should be cared for, that the whole surface of the luminous display equipment—when viewed from the desired solid angle—should illuminate with a uniform brightness and deformation of the image could be avoided.

In case of the embodiments shown up to now, this accessory requirement could not be met. In certain cases a lighting line may be seen, the size of which is conforming to the linear gap forming the diaphragm aperture 5, in other cases a lighting point with a diameter, that is equalling to the diameter of the diaphragm aperture 5, appears, the remaining part of the frontal surface of the luminous display equipment is dark.

This accessory requirement can be also met, when not one single lens is applied, but several elementary lenses and the connected elementary screening elements—forming a system—are inserted before the reflector 1 collimating the ray of light. The advantageous effects previously described are obtained, but simultaneously a uniformly illuminated image will appear on the frontal surface of the luminous display equipment, namely the overal picture of the illuminating points and lines uniformly distributed along the frontal surface.

A preferable embodiment of the version using several lenses is to be seen in FIG. 7. It may be well seen, that the collecting lenses 3 are arranged along the plane lying perpendicularly to the optical axle of the reflector 1, in lines below each other and in columns beside each other. Similarly, a board may be assembled, at which the multitude of the collecting lenses 3 is forming but one single line /or column/, or another type of board, where on a frontal surface of a rectangular cross-section the multitude of slices of the cylindrical lens filling a line /a column/ each is arranged along one single column /line/.

In FIG. 7 it may be seen, that the screening elements are arranged along a second plane being parallel to the first one, before and opposite to the collecting lenses 3.

In case, if the collecting lenses 3 are forming a body of rotation and are guiding the light into the focal point, the screening elements shown in FIG. *7/a* may be formed of the conical mantles 45 illustrated in FIG. *7/b* and before each single collecting lens 3 a similar screening system may be assembled, as it is to be seen in FIG. 6. It goes without saying, that the screening element may have the form of a pyramid mantle.

In case, if the collecting lenses 3 are formed by the convex, conveniently plano-convex slices of the cylindrical lens arranged along the first plane and beneath each other, where the geometrical axles are running parallel with the first plane, the screening elements 45' illustrated in FIG. *7/c* may be well used, where the divergent ends of the acute-angular profiles having been arranged parallel to the geometrical axle of the slices of the cylindrical linse are enclosing the space between the collecting lenses 3 and the screening element, while the diaphragm aperture 5 is formed in the vertex of the angular profiles, i.e. the convergent ends of the planes forming the angular profile are confining the diaphragm aperture 5.

As a matter of fact, the angular profile may be formed with an obtuse-angle, accordingly it can be stated in general, that the screening element is formed by two walls enclosing an angle being less, than 180°, furthermore it is not claimed, that the wall should be formed of planes. Walls may be used with good results, the projection of which in the plane running parallel with the optical axle of the reflector 1 and lying perpendicularly to the focal line of the collecting lens 3 is giving a broken or a curved line.

A particularly advantageous embodiment can be realized in those—frequently occuring—cases, when the solid angle of viewing is not circle-symmetrical with the axle of the luminous display equipment. This embodiment is represented by the majority of traffic lamps and the scoreboards. These are namely arranged in the eye-level of the viewer or above it, as a result, when applying the embodiments with circle-symmetrical characteristics previously described, a part of the light energy will be wasted. In FIG. 8 the embodiment being suitable for the realization of the accessory deflection has been illustrated differently detailed /FIG. 8/*a* and 8/*b*, respectively/. For different fields of application deflection may take place in different directions, e.g. it can be directed towards the sky. Change in direction may be effected in the most simple way by using the method previously described, in so far as the optical system illustrated here should be rotated around the axle lying perpendicularly to the plane of the figure in an optional angle. Often it becomes necessary to change the shape of the lenses or the screening elements in order to obtain the optimal deflecting characteristics. The collecting lenses 3 illustrated in FIG. 8 are formed of slices of the cylindrical lens arranged beneath each other along the first plane. Accordingly, the screening elements should be arranged also in lines, along the second plane. The screening elements are formed in an aforesaid manner, by walls enclosing an angle with each other being less, than 180°, where the convergent ends are confining the diaphragm aperture and the divergent ends are enclosing the space between the collecting lens 3 and the screening element. To the outer side of one of the walls 48 further walls 49 running parallel with the first one are attached. The characteristics of the accessory deflection are defined by the directional angle between the walls 47 and 48, respectively, whereas the deflection of the wall 47 is dependent on the shape of the slice of the cylindrical lens.

From the figure it emerges, that one of the sectional plane S of the slices of the cylindrical lens is running parallel to the optical axle of the reflector 1 and the focal line of the collecting lenses, the more, one of the sectional planes incorporates the focal lines. In this case the other wall 47 of the screening element runs parallel with the optical axle of the reflector 1 and the focal lines of the collecting lenses. In case, if a larger section is cut out from the cylinder, the optical axle of the reflector 1 is passing through the inner space of the slices of the cylindrical lens, thus the other wall 47 is lying in a plane, which is enclosing an acute angle around the slice of the cylindrical lens with the first plane. On the other hand, when a smaller part is cut out from the cylinder and the optical axle of the reflector does not even touch the slice of the cylindrical lens, but travels outside the same, the other wall of the screening element is lying in a plane, which is enclosing an obtuse angle with the first plane around the slice of the cylindrical lens. These facts are valid in those cases too, when the sectional plane under examination is not running parallel with the plane incorporating the optical axle of the reflector 1, but it is enclosing an angle with the same. Then the slice of the cylindrical lens, as a collecting lens guiding the rays of light towards the diaphragm aperture in the described optical system exerts its influence in the part enclosed by the projection of the sectional plane being parallel with the said plane.

The effect of deflection may be modified, when further slices of the cylindrical lens are used, which may have either collecting or scattering characteristics, or even displacing or turning characteristics. The further slices are preferably plano-convex, or plano-concave slices of the cylindrical lens.

At a further possible advantageous embodiment, along a further plane running parallel with the first one a plurality of identically shaped further slices of the cylindrical lens is arranged, whilst the geometrical axles of the further slices of the cylindrical lens are lying in a plane, which is perpendicular to the focal lines of the collecting lenses 3 arranged along the first plane. The distance between the first plane and the further planes can be such, that the slices of the cylindrical do not even touch each other, but a close arrangement is also possible, in which the slices adhere closely to each other i.e. the plurality of the slices of the cylindrical lens are fitted to the multitude of the collecting lenses 3 arranged in the first plane. This may take place on any side of the first plane, at a preferred embodiment all further planes are lying behind the first plane.

A further preferred embodiment is shown in FIG. 9/*a* and 9/*b*, showing two different views of the arrangement. In this arrangement, further slices of the cylindrical lens are fitted to the convex surface of the collecting lenses 3 arranged along the first plane, the geometrical axles of which are curves running parallel with the generatix of the convex surface, accordingly they are lying in a plane being perpendicular to the focal line of the collecting lens 3 arranged in the first plane. In practice, said arrangement can be formed in such a manner, that the multitude of the slices of the cylindrical lens of the desired form /f.i. plano-concave/, made of a resilient material, are arranged along the straight geometrical axle, hereafter they are bent onto the collecting lens 3 and glued to it. The resultant shape may be produced by using a technology, in course of which the complete system of the slices of the cylindrical lens is shaped in a monolithic body—e.g. as a pressed /moulded/ synthetic bodi /FIG. 9/. This technology may be conveniently used as well as for the lenses as the screening elements or for the combination thereof.

At the most different versions and embodiments, either the lens, or the screening elements, or both can be coloured, the combination of the colours becomes also possible, while before, beside the screening elements and lens and inbetween colour effect producing transparent means, e.g. foils may be arranged, which are shaped thatway, that they practically do not influence the deflecting and screening effect, respectively, but may modify the wavelengths of the rays of light.

Up to now the invention has been described in accordance with the theoretical arrangement resulting from the fundamental rules of functional mechanism, the effect of which is to be realized by all means in practical embodiments. However, in practice the characteristics described here may appear as virtual characteristics, which are performing their function correctly from the point of view of optics, but - due to technological considerations - will slightly differ in their actual form. This is the case at the diaphragm apertures. As it is to be seen in FIGS. 4 and 5, the prerequisite of the unhindered travel of the light lies in, that the diaphragm aperture in the focal point should enable the transgress of the light energy coming from the reflector 1 without any loss, simultaneously the presence of the disturbing energies should be allowed but to a restricted extent. Accordingly, the effective cross-section of the diaphragm aperture in the focal point must not be less, than the enclosing dimension of any beam of ray to be awaited under operational circumstances /should it be less, a part of the energy is going to be lost/, but it should not be larger, than it is absolutely necessary for safe transgressing.

From the known connections between the optical systems it becomes obvious, that in case of existence of the nominal parameters of focussing /included the shape and size of the light source 2/ the cross-section of the beam occuring in the focal point at different light outputs can be determined in accordance with the practically applied tolerances of the scattering. In case, if the diaphragm aperture 5 is actually arranged in the plane incorporating the focal point, the cross-section /eventually the height and width/ is to be chosen thatway, that it should be larger, that the cross-section /the diagonal/ of the maximal beam of light to be expected.

It is not necessary to arrange to diaphragm aperture 5 in said plane: in the actual arrangement the convergent ends of the walls confining the diaphragm aperture are not necessarily lying in the plane perpendicular to the optical axle and incorporating the focal point /see e.g. FIGS. 4 and 5/. Said ends may lie e.g. in a parallel plane, in a distance of $\pm\Delta x$; in FIG. 6 the case of $-\Delta x$ has been illustrated, when the distance between the diaphragm cell and the collecting lens 3 is less, than the distance to the focal point. In case, if $\Delta x$ is positive, the screen is extending beyond the focal point. The plane touching the convergent ends of the two walls may be represented by a plane, which is enclosing with the optical axle an angle deviating from 90°.

In case, if the screening body 4 is not arranged in the plane incorporating the focal point, the actual size of the diaphragm aperture will deviate from the size calculated for the focal point, why, this size should be such, that under the conditions of deflection, defined by the geometry, the actual diaphragm aperture 5 should exert an effect, as if a diaphragm aperture of theoretically correct size were present in the plane incorporating the focal point. Even then the expedient size of the diaphragm aperture is related to the plane incorporating the focal point /the focal line/. If the diaphragm aperture actually lies in said plane, the diaphragm aperture should be dimensioned in compliance with the maximal size of the beam of rays to be expected.

In case if the diaphragm aperture is not lying in said plane, dimensioning is taking place in such a manner, that the size extrapolated to said plane should meet the requirements defined by the beam: the characterizing contours of the screening body /the walls exerting the screening influence/ are drawn, the beam of rays resulting from the characteristics of the optical system will be indicated and the diagonal is to be determined, which is cut out by the beam of rays-transmitted due to the actual affect of the diaphragm aperture-from the line lying perpendicularly to the optical axle and incorporating the focal point. This size represents the extrapolated size of the actual diaphram aperture. Similarly, the cross-section, resp. the sizes of the linear diaphragm apertureformed in the environment of the focal line can be also extrapolated.

The expedient size of the diaphragm aperture can be obtained in such a manner, that the cross-section /the height and width/ of the diaphragm aperture 5, measured in the plane lying perpendicularly to the optical axle of the reflector 1 and incorporating the focal point /focal line/ of the reflector 1 and of the collecting lens 3, respectively, —i.e. the cross-section extrapolated to the plane—should be larger, than the conforming size /cross-section, diagonal/ of the beam of light to be expected in the focal point /focal line/ in accordance with the focussing determined by the nominal parameters.

In general, tolerances resulting from productional technology cannot be avoided. In case, if dimensioning is based on approximation and probability resulting from scattering, tolerances are of increased importance.

Several experiments have been performed by using the luminous display equipment produced in accordance with the invention and it could be stated, that transmission without losses and simultaneous considerable reduction of disturbing effects could be achieved, when the cross-section of the diaphragm aperture 5, related or extrapolated to the plane of the focal point, is exceeding by at least 5% the the cross-section /diagonal/ of the beam of light defined in accordance with geometrical correlations. A satisfactory reduction in disturbing effects may be obtained, when the difference is not more, than 20%. In general, the arrangement can be considered as satisfactory, when the cross-section of the diaphragm aperture measured in the focal point is exceeding by approx. 10% the maximal cross-section of the beam.

From the aforesaid it becomes obvious, that based on the concept of the invention a multitude of versions and embodiments may be produced, at which the advantage resulting from the invention may be achieved—however, to different extent—by all means. Accordingly, by using the arrangement according to the invention, the prevailing requirements and operational conditions can be always met.

What we claim:

1. In an optical system for the light point of an illuminated signal or display device having at least one light point, the system comprising at least one light deflecting means optically coupled with the light source of the light point and focussing the light passing through an effective aperture of the said deflecting means towards a focal point or line, and at least one light shield disposed in the light path and having an aperture in the focal point or line, a plurality of the deflecting means with the corresponding light shields being disposable in rows and columns of a display board, the improvement wherein the light shield has a mantle framing a tapering hollow with its mouth facing the light deflecting means and narrowing towards the aperture of the light shield and wherein the mantle is disposed parallel to and encircling rays departing from the periphery of the effective aperture of the light deflecting means and converging into the focal point or line.

2. The optical system as claimed in claim 1, wherein the mantle of the light shield has at the side not facing the light deflecting means at least one light guide shaft directed parallel to and encircling the optical axis of the light deflecting means.

3. The optical system as claimed in claim 2, wherein the mantle of the light shield and the walls of the light guide shaft each comprise a pair of flat plates facing each other while encircling the optical axis of the light deflecting means.

4. The optical system as claimed in claim 2, wherein the light shield mantle envelopes a conical hollow with said aperture in the apex thereof and the light guide shaft is a pipe-end of angular cross-section.

5. The optical system as claimed in claim 2, wherein the light shield mantle envelopes a pyramidal hollow with said aperture in the apex thereof and the light guide shaft is a pipe-end of square cross-section.

6. The optical system as claimed in claim 2, wherein the light shield mantle envelopes an obelisk shaped hollow with the aperture in the cover plane thereof and the light guide shaft is a pipe-end of rectangular cross-section.

7. The optical system as claimed in claim 2, wherein a plurality of light guide shafts are provided and the outer light guide shaft is of a length wherein $$2\times f > L > 1.5\times f$$

and f is the focal length of the light deflecting means.

8. The optical system as claimed in claim 7, wherein any light guide shaft arranged inside the outer light guide shaft symmetrically encircles the optical axis of the light deflecting means and its length is in the range of $$0.95\times L\times D_1/D \leqq L_1 \leqq 1.05\times L\times D_1/D,$$

, or $$0.95\times L\times M_1/M \leqq L_1 \leqq 1.05\times L\times M_1/M,$$

where $D_1$ and $M_1$ are the diameter or the height, respectively, of the cross-section encircled by an inner light guide shaft.

9. The optical system as claimed in claim 3 or 6, wherein the light deflecting means comprises cylinder segment lenses arranged in rows or columns beside each other.

10. The optical system as claimed in claim 9, wherein the said cylinder segment lenses are plane-convex shaped bodies and one secant of same is at least parallel to the optical axis of the light deflecting means.

11. The optical system as claimed in claim 10, further comprising a cylinder segment lens is arranged in series with each of the said cylinder segment lenses such that in each lens pair the focal lines of the two lenses lie perpendicularly to each other.

12. The optical system as claimed in claim 11, wherein the lenses bear against each other.

13. The optical system as claimed in claim 2, further comprising a rectangular shaped frame and lenses, light shields, and light guide shafts are shaped to match the said frame.

14. The optical system as claimed in claim 1, wherein the optical systems of at least a part of the light points of the said illuminated signal or display device are forming an integrated common body.

15. The optical system as claimed in claim 14, wherein the common body comprises pressed plastic.

* * * * *